US012516828B2

(12) United States Patent
Hagiwara et al.

(10) Patent No.: US 12,516,828 B2
(45) Date of Patent: Jan. 6, 2026

(54) INDOOR UNIT AND AIR CONDITIONER

(71) Applicant: Mitsubishi Electric Corporation, Tokyo (JP)

(72) Inventors: Yusuke Hagiwara, Tokyo (JP); Kenta Tsuji, Tokyo (JP); Takanori Yoshida, Tokyo (JP); Takashi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 18/725,605

(22) PCT Filed: Mar. 30, 2022

(86) PCT No.: PCT/JP2022/015899
§ 371 (c)(1),
(2) Date: Jun. 28, 2024

(87) PCT Pub. No.: WO2023/188084
PCT Pub. Date: Oct. 5, 2023

(65) Prior Publication Data

US 2025/0216093 A1 Jul. 3, 2025

(51) Int. Cl.
*F24F 1/0025* (2019.01)
*F24F 13/08* (2006.01)
(Continued)

(52) U.S. Cl.
CPC ..... *F24F 1/0025* (2013.01); *F24F 13/08* (2013.01); *F24F 13/22* (2013.01); *F24F 13/24* (2013.01);
(Continued)

(58) Field of Classification Search
CPC ..... F24F 1/0025; F24F 13/08; F24F 13/22; F24F 13/24; F24F 2013/228; F24F 2013/247
See application file for complete search history.

(56) References Cited

U.S. PATENT DOCUMENTS 6,374,628 B2 * 4/2002 Willkommen ..... F28F 17/005 62/426
9,879,868 B2 * 1/2018 Hirakawa ..... F24F 1/0025
(Continued)

FOREIGN PATENT DOCUMENTS

JP 05164353 A 6/1993
JP 05231667 A 9/1993
(Continued)

OTHER PUBLICATIONS

International Search Report of the International Searching Authority mailed Jun. 21, 2022 in corresponding International Application No. PCT/JP2022/015899 (and English translation).
(Continued)

*Primary Examiner* — Brian Christopher Delrue
(74) *Attorney, Agent, or Firm* — Posz Law Group, PLC

(57) ABSTRACT

An aspect of an indoor unit according to the present disclosure is an indoor unit of an air conditioner, the indoor unit including: a heat exchanger; a cross-flow fan; a housing that includes a suction port and a blowout port and that accommodates the heat exchanger and the cross-flow fan therein; and a stabilizer that separates a suction flow path and a blowout flow path of the cross-flow fan from each other, in which the stabilizer includes a tongue portion that extends along an outer circumferential surface of the cross-flow fan and that has a facing surface facing the cross-flow fan, a first protrusion portion that protrudes from the facing surface toward the cross-flow fan, and a second protrusion portion that protrudes from the facing surface toward the cross-flow fan and that is located closer to a blowout flow path than the first protrusion portion.

7 Claims, 7 Drawing Sheets

(51) Int. Cl.
*F24F 13/22* (2006.01)
*F24F 13/24* (2006.01)

(52) U.S. Cl.
CPC ... *F24F 2013/228* (2013.01); *F24F 2013/247* (2013.01)

(56) References Cited

U.S. PATENT DOCUMENTS

| | | | | |
|---|---|---|---|---|
| 10,088,176 | B2 * | 10/2018 | Ikeda | F24F 1/0057 |
| 11,441,790 | B2 * | 9/2022 | Choi | F24F 1/0011 |
| 2005/0223732 | A1 * | 10/2005 | Kim | F24F 1/0011 62/298 |
| 2008/0181764 | A1 * | 7/2008 | Hirakawa | F04D 29/681 415/53.2 |
| 2012/0031134 | A1 * | 2/2012 | Shirota | F24F 1/0029 62/288 |
| 2015/0300663 | A1 * | 10/2015 | Hirakawa | F24F 3/06 165/104.34 |
| 2017/0003038 | A1 * | 1/2017 | Uda | F24F 13/28 |

FOREIGN PATENT DOCUMENTS

| | | | |
|---|---|---|---|
| JP | 2004-150789 | A | 5/2004 |
| WO | 2014/091798 | A1 | 6/2014 |

OTHER PUBLICATIONS

Japanese Office Action mailed Jun. 3, 2025 in corresponding Japanese Patent Application No. 2024-510869 (and English machine translation).

Office Action issued on Nov. 4, 2025 in corresponding Japanese patent application No. 2024-510869 (and English machine translation).

* cited by examiner

INDOOR UNIT AND AIR CONDITIONER

CROSS-REFERENCE TO RELATED APPLICATION

This application is a U.S. national stage application of International Application No. PCT/JP2022/015899 filed Mar. 30, 2022, the contents of which are incorporated herein by reference.

TECHNICAL FIELD

The present disclosure relates to an indoor unit and an air conditioner.

BACKGROUND

In the related art, an indoor unit of an air conditioner equipped with a cross-flow fan has been known. Inside such an indoor unit, a stabilizer that separates a suction flow path and a blowout flow path of the cross-flow fan from each other is provided. The stabilizer forms a circulating vortex at a boundary portion between the suction flow path and the blowout flow path. The circulating vortex may become larger in a case where a ventilation resistance of a suction port increases as an operation time of the indoor unit increases, and may cause condensation by drawing humid indoor air into a blowout port. Patent Document 1 discloses an indoor unit in which a protrusion is provided in a stabilizer in order to move a circulating vortex closer to a suction flow path and suppress the occurrence of a backflow.

PATENT DOCUMENT

Patent Document 1

Japanese Unexamined Patent Application, First Publication No. 2004-150789

In the indoor unit described in Patent Document 1, since the circulating vortex is moved closer to the suction flow path by providing the protrusion, there is a problem in that the circulating vortex collides with the stabilizer in a case where the ventilation resistance is low, conversely. In a case where the stabilizer and the circulating vortex collide with each other, there is a problem in that a pressure fluctuation at a collision zone increases, and a rotation sound of the cross-flow fan becomes louder.

SUMMARY

In view of the above-described circumstances, an object of the present disclosure is to provide an indoor unit capable of suppressing the occurrence of internal condensation and the occurrence of noise, and an air conditioner including the indoor unit.

An aspect of an indoor unit according to the present disclosure is an indoor unit of an air conditioner, the indoor unit including: a heat exchanger: a cross-flow fan; a housing that includes a suction port and a blowout port and that accommodates the heat exchanger and the cross-flow fan therein: and a stabilizer that separates a suction flow path and a blowout flow path of the cross-flow fan from each other, in which the stabilizer includes a tongue portion that extends along an outer circumference surface of the cross-flow fan and that has a facing surface facing the cross-flow fan, a first protrusion portion that protrudes from the facing surface toward the cross-flow fan, and a second protrusion portion that protrudes from the facing surface toward the cross-flow fan and that is located closer to the blowout flow path than the first protrusion portion, the first protrusion portion has a first rectifying surface that faces the blowout flow path and is inclined toward a suction flow path toward a tip side of the first protrusion portion, the second protrusion portion has a second rectifying surface that faces the blowout flow path and that is inclined toward the suction flow path toward a tip side of the second protrusion portion, and the first rectifying surface and the second rectifying surface are each inclined toward the suction flow path at an acute inclination angle with respect to a radial direction of the rotation axis.

An aspect of an air conditioner according to the present disclosure includes: the indoor unit; and an outdoor unit.

According to the present disclosure, it is possible to provide an indoor unit capable of suppressing the occurrence of internal condensation and the occurrence of noise, and an air conditioner including the indoor unit.

DETAILED DESCRIPTION

Figure 1:
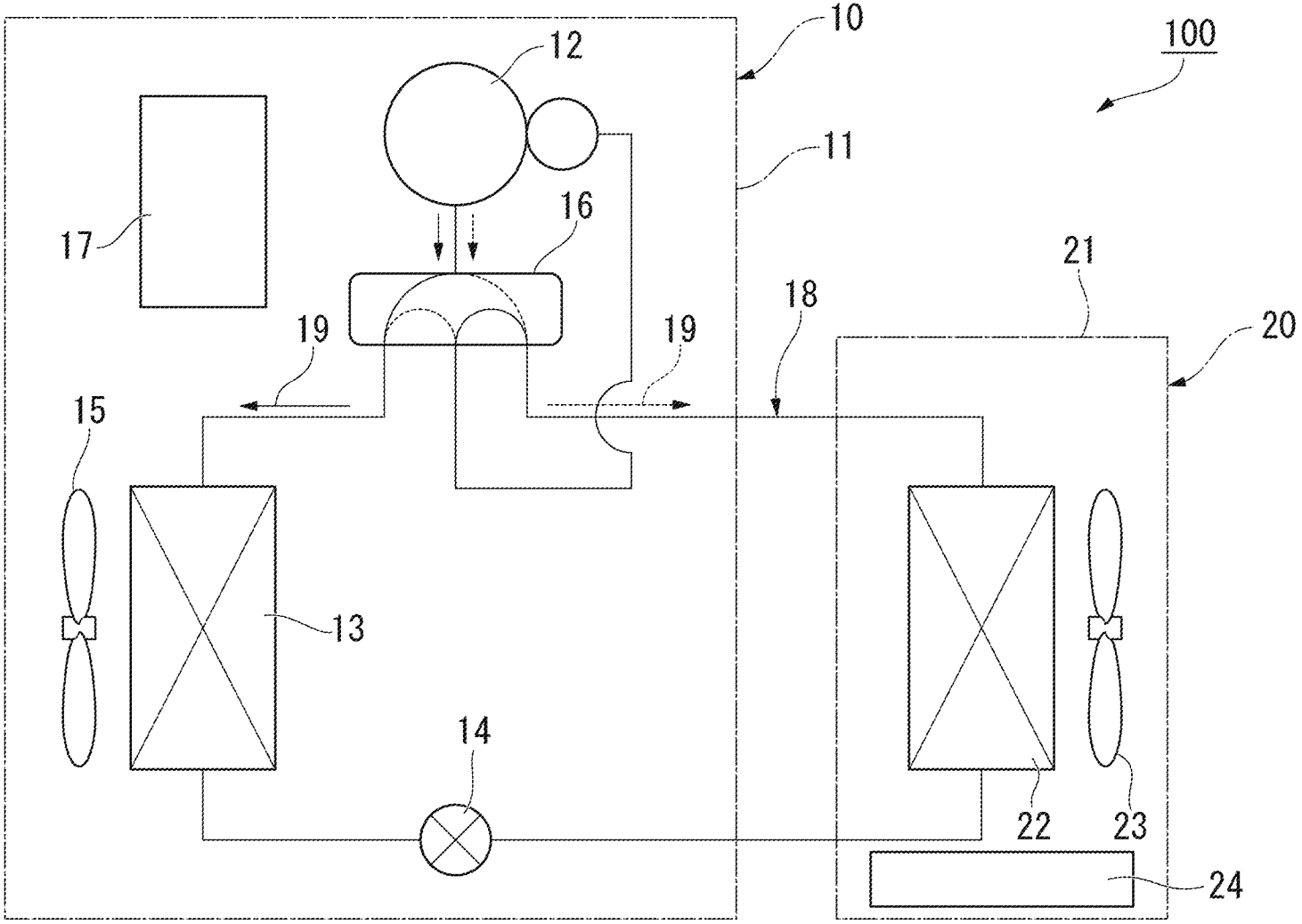
FIG. 1 is a schematic diagram showing a schematic configuration of an air conditioner according to an embodiment.

Hereinafter, an embodiment of the present disclosure will be described with reference to the drawings. The scope of the present disclosure is not limited to the following embodiment, and can be changed in any way within the scope of technical ideas of the present disclosure. In addition, in the following drawings, a scale and the number in each structure may be different from a scale and the number in an actual structure to facilitate understanding of each configuration.

In addition, in the drawings, an X-axis, a Y-axis, and a Z-axis are shown as appropriate. The X-axis indicates one direction in a horizontal direction. The Y-axis indicates another direction in the horizontal direction. The Z-axis indicates a vertical direction. In the following description, a horizontal direction along the X-axis is referred to as a "front-rear direction X", a horizontal direction along the Y-axis is referred to as a "left-right direction Y", and a vertical direction is referred to as a "vertical direction Z". The front-rear direction X, the left-right direction Y, and the vertical direction Z are directions orthogonal to each other. In the following description, a side (+Z side) in the vertical direction Z to which an arrow on the Z-axis points is defined as an upper side, and a side (−Z side) in the vertical direction Z opposite to the side to which the arrow on the Z-axis points is defined as a lower side. In addition, a side (+X side) of the front-rear direction X to which an arrow on the X-axis points is defined as a front side, and a side (−X side) in the front-rear direction X opposite to the side to which the arrow on the X-axis points is defined as a rear side. In addition, the left-right direction Y is a left-right direction in a case in which the indoor unit of the embodiment described below is viewed from the front (+X side). That is, a side (+Y side) in the left-right direction Y to which an arrow on the Y-axis points is defined as a right side, and a side (−Y side) in the left-right direction Y opposite to the side to which the arrow on the Y-axis points is defined as a left side.

FIG. 1 is a schematic diagram showing a schematic configuration of an air conditioner 100 according to the present embodiment. As shown in FIG. 1, the air conditioner 100 includes an outdoor unit 10, an indoor unit 20, and a circulation path portion 18. The outdoor unit 10 is disposed outdoors. The indoor unit 20 is disposed indoors. The outdoor unit 10 and the indoor unit 20 are connected to each other by the circulation path portion 18 through which a refrigerant 19 circulates.

The air conditioner 100 enables heat exchange between the refrigerant 19 flowing inside the circulation path portion 18 and the air in a room in which the indoor unit 20 is disposed, thereby regulating a temperature of the air in the room. Examples of the refrigerant 19 include a fluorine-based refrigerant having a low global warming potential (GWP) and a hydrocarbon-based refrigerant.

The outdoor unit 10 includes a housing 11, a compressor 12, a heat exchanger 13, a flow regulating valve 14, a blower 15, a four-way valve 16, and a control unit 17. The compressor 12, the heat exchanger 13, the flow regulating valve 14, the blower 15, the four-way valve 16, and the control unit 17 are accommodated inside the housing 11.

The compressor 12, the heat exchanger 13, the flow regulating valve 14, and the four-way valve 16 are provided parts of the circulation path portion 18 located inside the housing 11. The compressor 12, the heat exchanger 13, the flow regulating valve 14, and the four-way valve 16 are connected by the parts of the circulation path portion 18 located inside the housing 11.

The four-way valve 16 is provided in a part of the circulation path portion 18 connected to a discharge side of the compressor 12. The four-way valve 16 can reverse a direction of the refrigerant 19 flowing inside the circulation path portion 18 by switching between paths of parts of the circulation path portion 18. In a case where the paths connected by the four-way valve 16 are the paths indicated by solid lines in the four-way valve 16 in FIG. 1, the refrigerant 19 flows inside the circulation path portion 18 in a direction indicated by a solid line arrow in FIG. 1. On the other hand, in a case where the paths connected by the four-way valve 16 are the paths indicated by dashed lines in the four-way valve 16 in FIG. 1, the refrigerant 19 flows inside the circulation path portion 18 in a direction indicated by a dashed line arrow in FIG. 1.

The indoor unit 20 includes a housing 21, a heat exchanger 22, a cross-flow fan 23 as a blower, and a control unit 24. The housing 21 accommodates the heat exchanger 22, the cross-flow fan 23, and the control unit 24 therein. The indoor unit 20 can perform a cooling operation for cooling the air in the room in which the indoor unit 20 is disposed and a heating operation for warming the air in the room in which the indoor unit 20 is disposed. In FIG. 1, the cross-flow fan 23 is schematically shown.

In a case where the indoor unit 20 performs the cooling operation, the refrigerant 19 flowing inside the circulation path portion 18 flows in the direction indicated by the solid line arrow in FIG. 1. That is, in the case where the indoor unit 20 performs the cooling operation, the refrigerant 19 flowing inside the circulation path portion 18 circulates to return to the compressor 12 after circulating through the compressor 12, the heat exchanger 13 of the outdoor unit 10, the flow regulating valve 14, and the heat exchanger 22 of the indoor unit 20 in this order. In the cooling operation, the heat exchanger 13 in the outdoor unit 10 functions as a condenser, and the heat exchanger 22 in the indoor unit 20 functions as an evaporator.

On the other hand, in a case where the indoor unit 20 performs the heating operation, the refrigerant 19 flowing inside the circulation path portion 18 flows in the direction indicated by the dashed line in FIG. 1. That is, in the case where the indoor unit 20 performs the heating operation, the refrigerant 19 flowing inside the circulation path portion 18 circulates to return to the compressor 12 after circulating through the compressor 12, the heat exchanger 22 of the indoor unit 20, the flow regulating valve 14, and the heat exchanger 13 of the outdoor unit 10 in this order. In the heating operation, the heat exchanger 13 in the outdoor unit 10 functions as an evaporator, and the heat exchanger 22 in the indoor unit 20 functions as a condenser.

Figure 2:
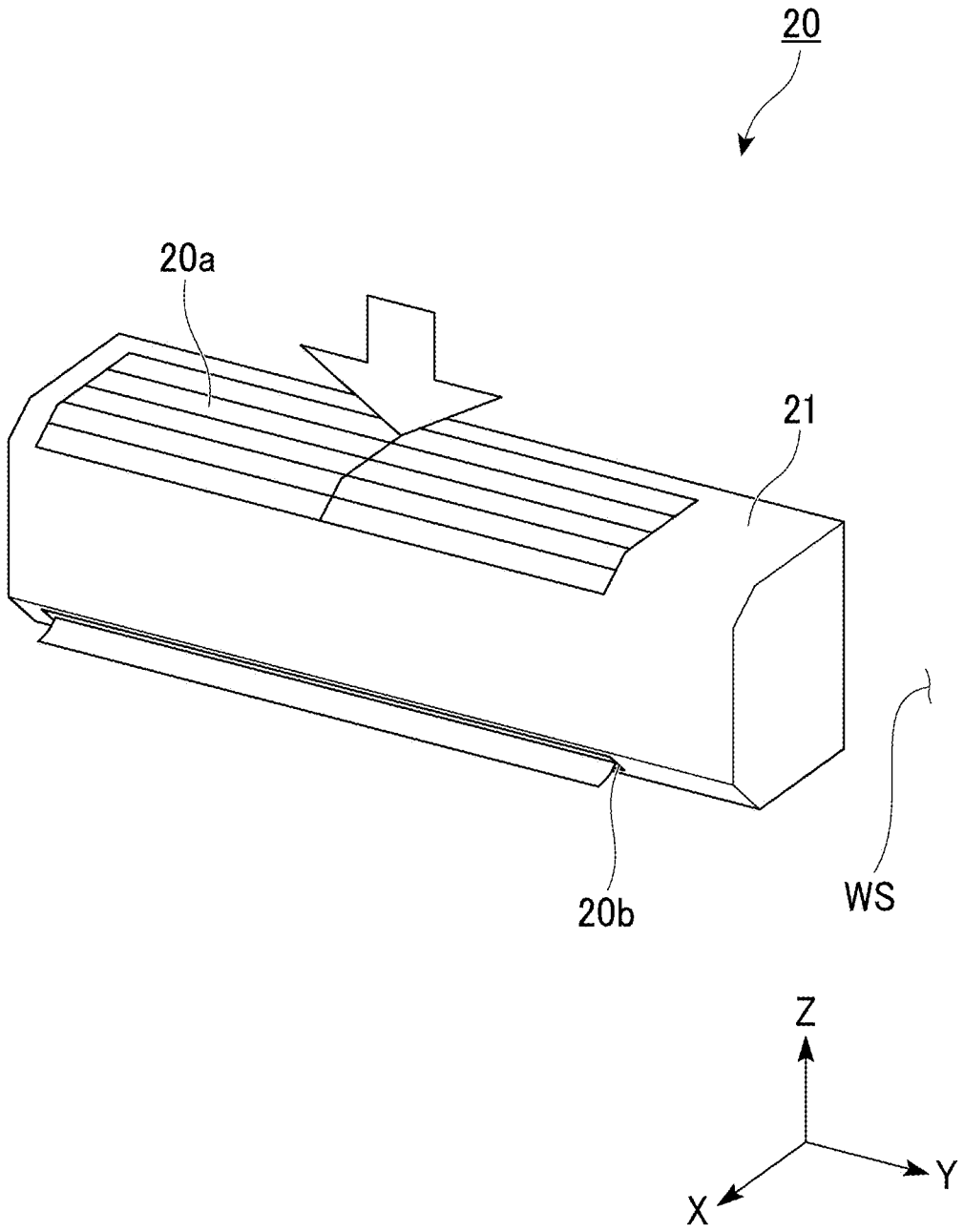
FIG. 2 is a perspective view of an indoor unit in the embodiment.
Figure 3:
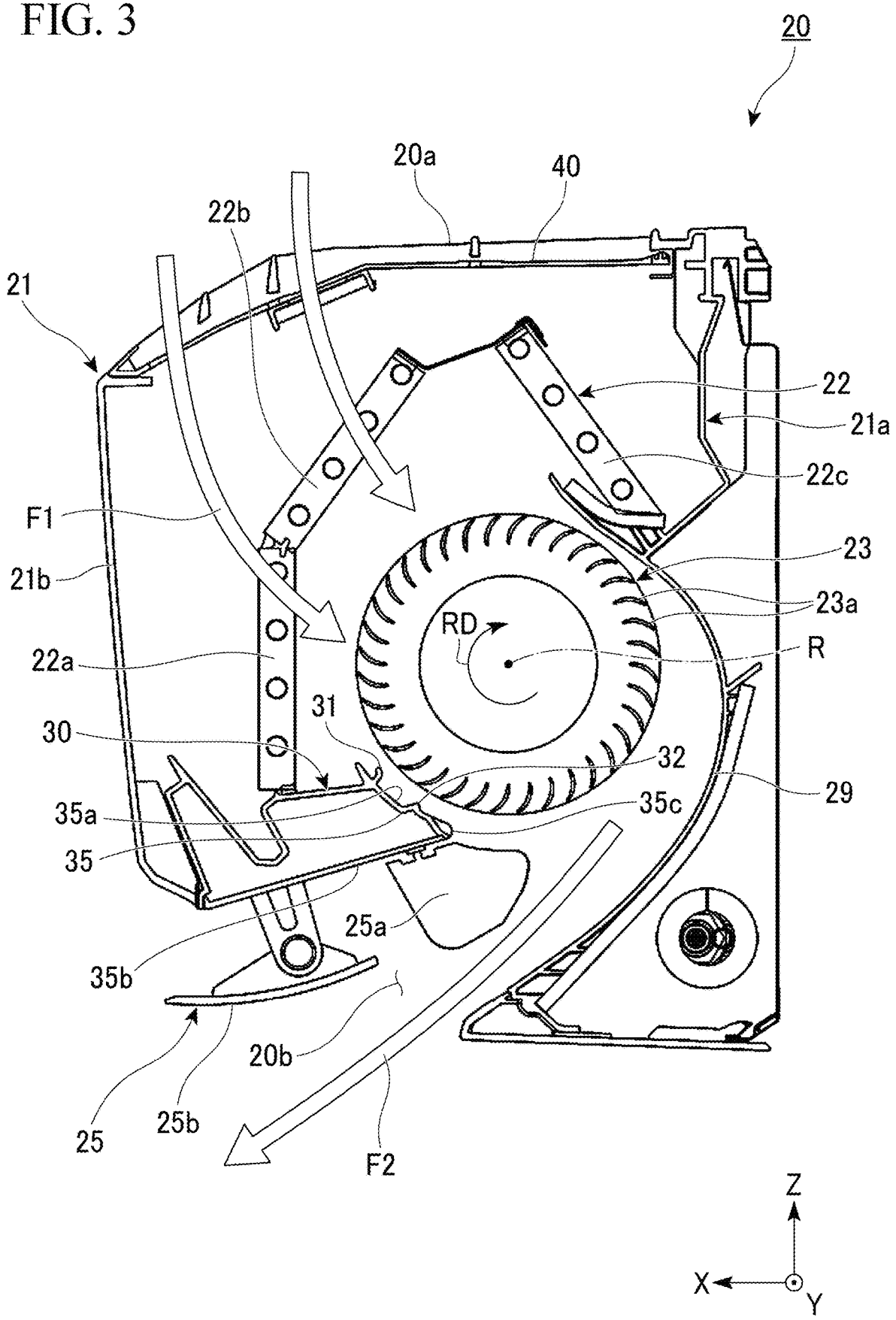
FIG. 3 is a cross-sectional view of the indoor unit in the embodiment.

Next, the indoor unit 20 will be described in more detail. FIG. 2 is a perspective view schematically showing the indoor unit 20. FIG. 3 is a cross-sectional view showing the indoor unit 20.

As shown in FIG. 2, the indoor unit 20 is a wall-mounted type indoor unit that is fixed to a wall surface WS of the room. The indoor unit 20 has a substantially rectangular shape that is long in the left-right direction Y.

As shown in FIG. 3, the cross-flow fan 23 is accommodated in the housing 21 of the indoor unit 20. The cross-flow fan 23 extends in the left-right direction Y. The cross-flow fan 23 rotates around a rotation axis R extending in the left-right direction Y. The cross-flow fan 23 includes a plurality of blades 23*a* arranged in a circumferential direction.

In the following description, unless otherwise specified, a direction (Y-axis direction) parallel to the rotation axis R of the cross-flow fan 23 is simply referred to as an "axial direction". The axial direction is the left-right direction Y of the indoor unit 20. In addition, a radial direction around the rotation axis R is simply referred to as a "radial direction". In addition, a circumferential direction around the rotation axis R, that is, a direction around the rotation axis R is simply referred to as a "circumferential direction", and a direction in which the cross-flow fan 23 rotates in the circumferential direction is referred to as a rotation direction RD.

The heat exchanger 22 has a first heat exchanger 22*a*, a second heat exchanger 22*b*, and a third heat exchanger 22*c*. The first heat exchanger 22*a* is located in front of the cross-flow fan 23. The first heat exchanger 22*a* extends in the vertical direction Z as viewed in the left-right direction Y. The second heat exchanger 22*b* and the third heat exchanger 22*c* are located above the cross-flow fan 23. The second heat exchanger 22*b* extends upward and obliquely rearward from an upper end portion of the first heat exchanger 22*a* as viewed in the left-right direction Y. The third heat exchanger 22*c* is located rearward of the second heat exchanger 22*b*. The third heat exchanger 22*c* extends downward and obliquely rearward from an upper end portion of the second heat exchanger 22*b* as viewed in the left-right direction Y.

The housing 21 has an outer shell member 21*b* and a wind path member 21*a*. The outer shell member 21*b* is a member that constitutes a part of an outer shell of the housing 21. The outer shell member 21*b* improves designability of an external appearance of the indoor unit 20. The outer shell member 21*b* has a substantially rectangular box shape that is open to the rear. An opening of the outer shell member 21*b* on the rear side is blocked by the wind path member 21*a*.

The wind path member 21*a* is a member that constitutes a part of a wind path through which the air suctioned into the housing 21 by the cross-flow fan 23 passes. The wind path member 21*a* is hooked on an installation plate (not shown) that is fixed to the wall surface WS. Accordingly, the indoor unit 20 is fixed to the wall surface WS.

The wind path member 21*a* includes a casing portion 29. The casing portion 29 extends along an outer circumference of the cross-flow fan 23 on a rear side of the cross-flow fan 23. The casing portion 29 is gradually spaced apart from the outer circumference of the cross-flow fan 23 toward a lower side of the casing portion 29. A blowout flow path F2 of the cross-flow fan 23 is formed in a gap between the cross-flow fan 23 and the casing portion 29 on a lower side of the cross-flow fan 23. In the present specification, the "outer circumference of the cross-flow fan" means a cylindrical plane of a rotation trajectory of radially outer end portions of the blades 23*a* provided in the cross-flow fan 23.

The housing 21 has a suction port 20*a* and a blowout port 20*b*. In the present embodiment, the suction port 20*a* and the blowout port 20*b* are formed in the outer shell member 21*b*. The suction port 20*a* opens upward and extends in the axial direction. A filter 40 is disposed in the suction port 20*a*. On the other hand, the blowout port 20*b* opens forward and downward and extends in the axial direction. A wind direction adjusting portion 25 is disposed in the blowout port 20*b*. The wind direction adjusting portion 25 has a left-right wind direction vane 25*a* that adjusts a wind direction in the left-right direction Y and an up-down wind direction vane 25*b* that adjusts a wind direction in the vertical direction Z.

The air in the room is suctioned into an inside of the housing 21 from the suction port 20*a* by drive of the cross-flow fan 23. The air suctioned into the housing 21 from the suction port 20*a* passes through the filter 40 and then flows to the heat exchanger 22. The filter 40 captures at least some of dust contained in the air passing through the filter 40. Furthermore, the air suctioned into the housing 21 by the cross-flow fan 23 is blown into the room from the blowout port 20*b*. The air passing through the blowout port 20*b* is blown into the room in the vertical direction Z and in the left-right direction Y separately by the wind direction adjusting portion 25.

The indoor unit 20 has a stabilizer 30. The stabilizer 30 is disposed inside the housing 21. The stabilizer 30 is disposed on a lower side of the suction flow path F1 and on an upper side of the blowout flow path F2. The stabilizer 30 separates the suction flow path F1 and the blowout flow path F2 of the cross-flow fan 23 from each other. The stabilizer 30 extends from a panel on a front surface side of the housing 21 toward the lower side of the cross-flow fan 23. The stabilizer 30 is located on a lower side of the first heat exchanger 22*a*.

The stabilizer 30 includes a top surface 35*b* located on the upper side of the blowout flow path F2. The top surface 35*b* of the present embodiment faces the lower side. The top surface 35*b* is provided with the left-right wind direction vane 25*a* and the up-down wind direction vane 25*b*.

Figure 4:
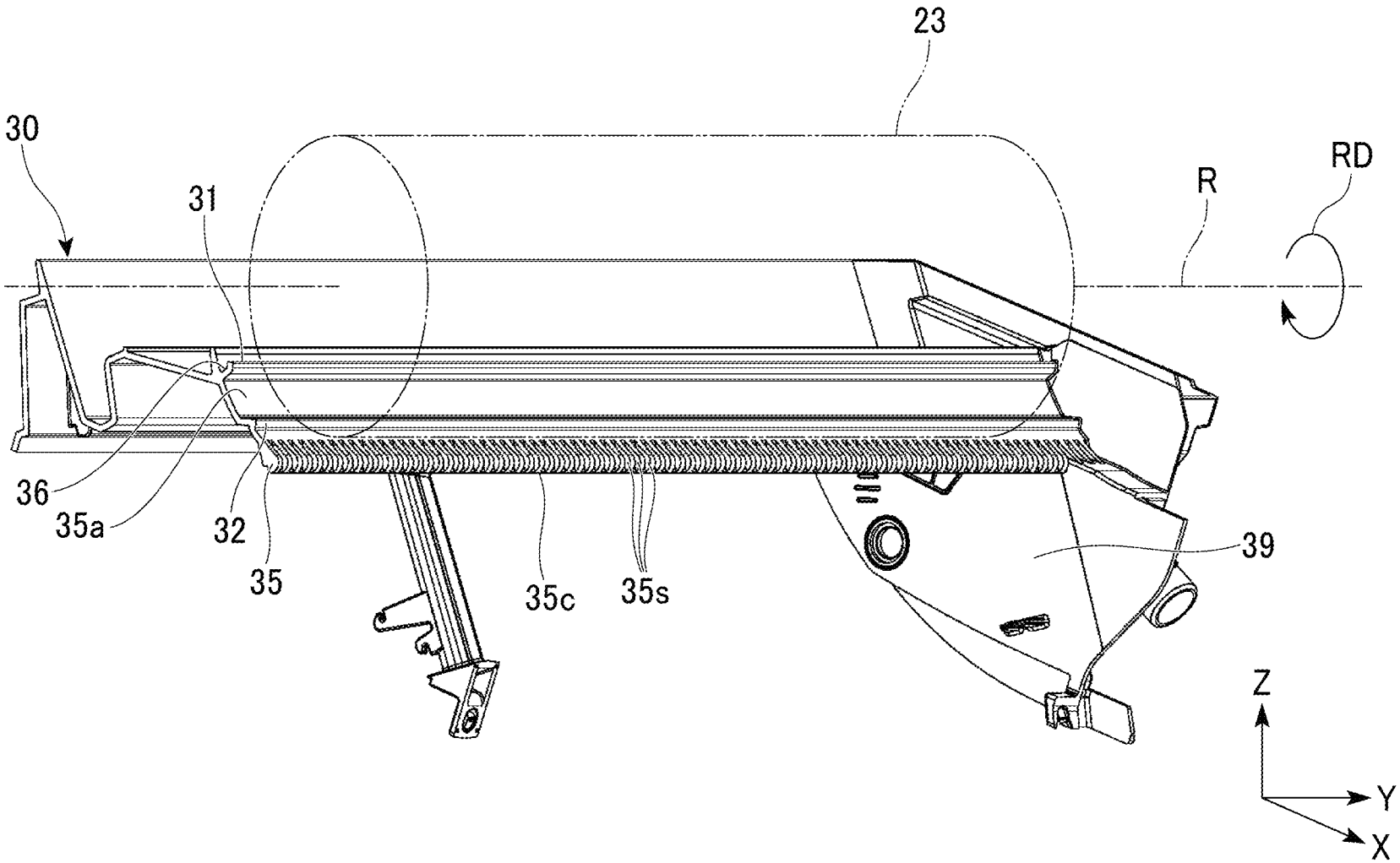
FIG. 4 is a perspective view of a stabilizer in the embodiment.

FIG. 4 is a perspective view of the stabilizer 30.

The stabilizer 30 is a resin molded product. The stabilizer 30 has a tongue portion 35, a first protrusion portion 31, a second protrusion portion 32, and a side plate portion 39. The tongue portion 35, the first protrusion portion 31, and the second protrusion portion 32 extend over an entire axial length of the cross-flow fan 23. That is, right end portions of the tongue portion 35, the first protrusion portion 31, and the second protrusion portion 32 are located on the right side (+Y side) with respect to a right end portion of the cross-flow fan 23. Left end portions of the tongue portion 35, the first protrusion portion 31, and the second protrusion portion 32 are located on the left side (−Y side) with respect to a left end portion of the cross-flow fan 23.

As shown in FIG. 3, the tongue portion 35 is disposed with a gap from an outer circumferential surface of the cross-flow fan 23. The tongue portion 35 has a facing surface 35*a* that is disposed to face the cross-flow fan 23. The tongue portion 35 extends along the outer circumferential surface of the cross-flow fan 23.

The tongue portion 35 is provided with the facing surface 35*a* that faces the cross-flow fan 23. The facing surface 35*a* faces an inner side in the radial direction. The facing surface 35*a* extends in the axial direction in a uniform shape.

The tongue portion 35 has an end portion 35*c* located closer to a blowout flow path F2. In the following description, the end portion of the tongue portion 35 closer to the blowout flow path F2 is simply referred to as an end portion 35*c*. The end portion 35*c* forms a curved surface that smoothly curves between the facing surface 35*a* and the top surface 35*b* of the blowout port 20*b*. As shown in FIG. 4, a plurality of slits 35*s* arranged in the axial direction are provided in the end portion 35*c* of the tongue portion 35.

Figure 5:
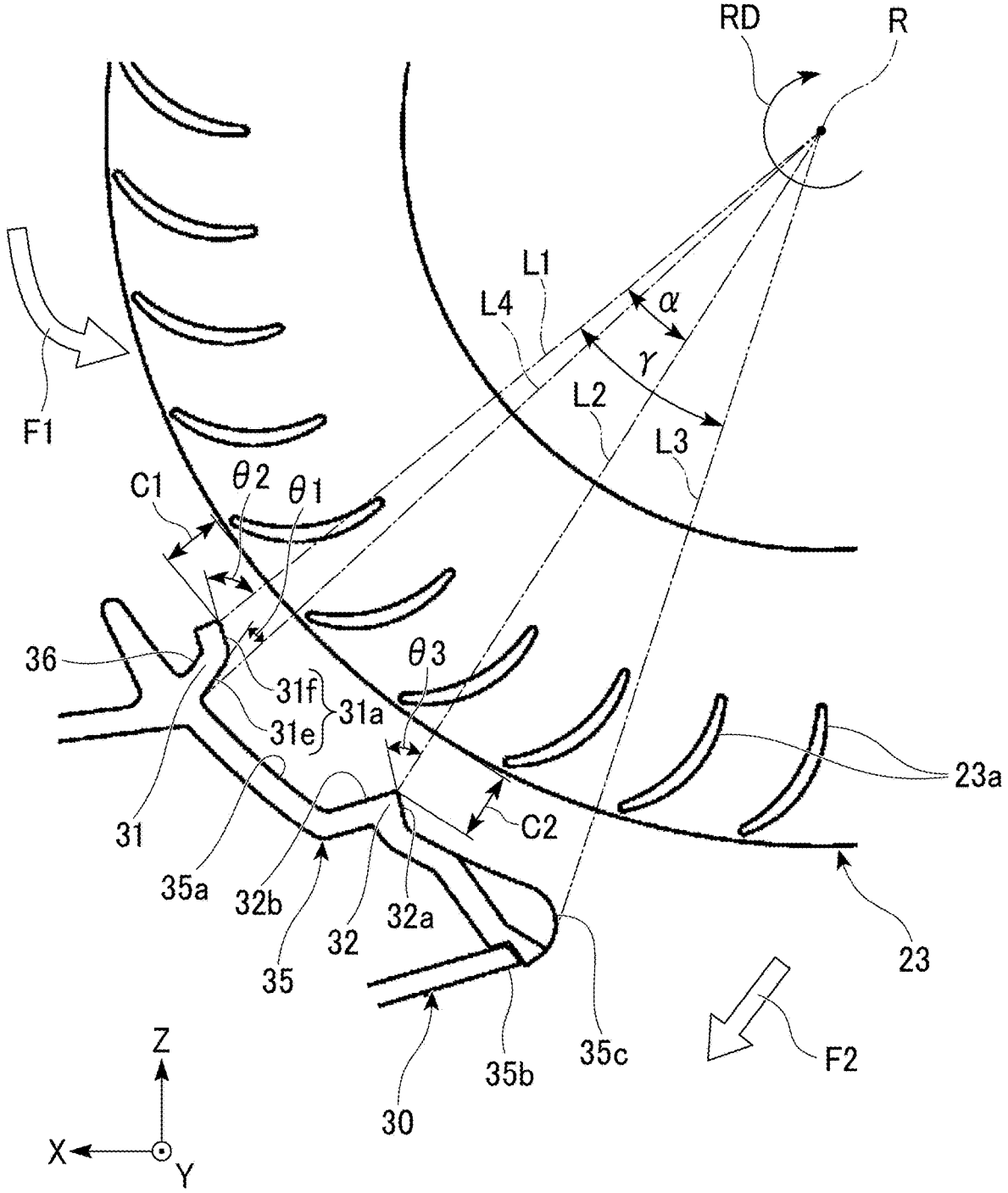
FIG. 5 is a partially enlarged view showing a part of FIG. 3.

FIG. 5 is a partially enlarged view of FIG. 3.

The first protrusion portion 31 protrudes from the facing surface 35*a* of the tongue portion 35 toward the cross-flow fan 23. Similarly, the second protrusion portion 32 protrudes from the facing surface 35*a* of the tongue portion 35 toward the cross-flow fan 23. The second protrusion portion 32 is located closer to the blowout flow path F2 than the first protrusion portion 31.

The tongue portion 35 and the first protrusion portion 31 according to the present embodiment are each plate-shaped. That is, the first protrusion portion 31 has a rib shape that extends from the tongue portion 35. Therefore, it is possible to suppress a local increase in thickness of the tongue portion 35 at a connection portion with the first protrusion portion 31. Therefore, in a case where the tongue portion 35 is manufactured by die molding, the generation of a sink mark in the tongue portion 35 during the molding can be suppressed, and as a result, dimensional accuracy of each portion of the stabilizer 30 can be increased.

In addition, in the present embodiment, a recess portion 36 is provided between the first protrusion portion 31 and the tongue portion 35. The recess portion 36 is a space surrounded by the first protrusion portion 31 and the tongue portion 35. By forming the recess portion 36 between the first protrusion portion 31 and the tongue portion 35, rigidity of the first protrusion portion 31 and the tongue portion 35 can be increased.

In addition, the recess portion 36 according to the present embodiment opens toward the upper side. Therefore, condensation water generated in the housing 21 can be retained in the recess portion 36, and even in a case where the condensation water is generated in the housing 21, dripping of the condensation water into the room from the blowout port 20*b* can be suppressed. Furthermore, the recess portion 36 of the present embodiment is disposed directly below a front end (end portion on the +X side) of the cross-flow fan 23. Therefore, the recess portion 36 can efficiently receive the condensation water dripped from the front end of the cross-flow fan 23.

The second protrusion portion 32 of the present embodiment has a triangular shape as viewed in the axial direction of the cross-flow fan 23. That is, the second protrusion portion 32 is constituted by two surfaces, that is, a flat second rectifying surface (rectifying surface) 32*a* facing the blowout flow path F2 and a flat opposite side surface 32*b* facing the suction flow path F1. As will be described below, the second protrusion portion 32 has a lower protruding height than the first protrusion portion 31. Therefore, by causing the second protrusion portion 32 to have a triangular shape, it is easier to make the thickness of the tongue portion 35 uniform compared to a case where the second protrusion portion 32 has a plate shape like the first protrusion portion 31. According to the present embodiment, the generation of a sink mark in the second protrusion portion 32 after the molding can be suppressed, and the dimensional accuracy of each portion of the stabilizer 30 can be increased.

Figure 6:
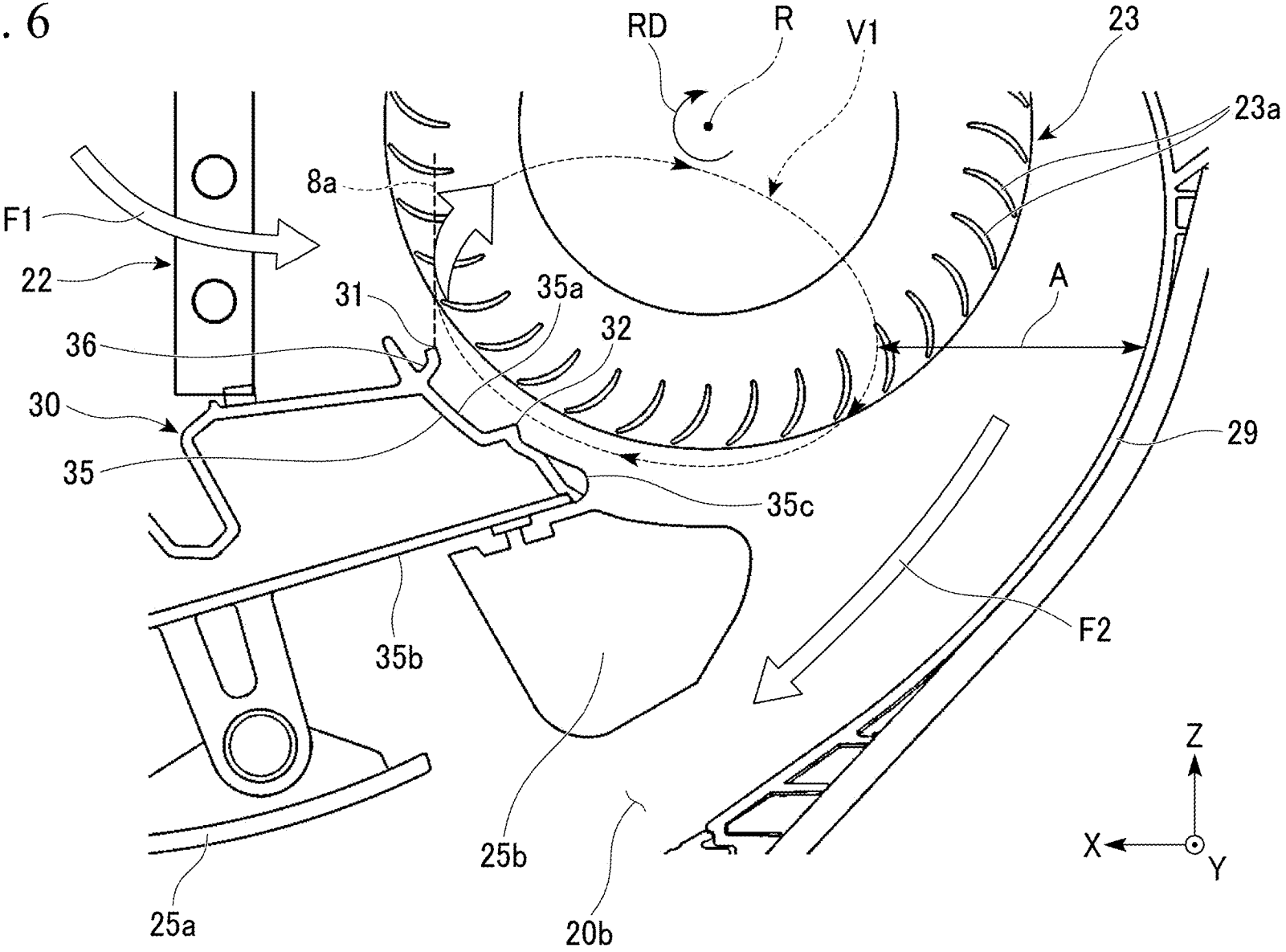
FIG. 6 is a cross-sectional view of the indoor unit in the embodiment, and is a diagram schematically showing a first circulating vortex.
Figure 7:
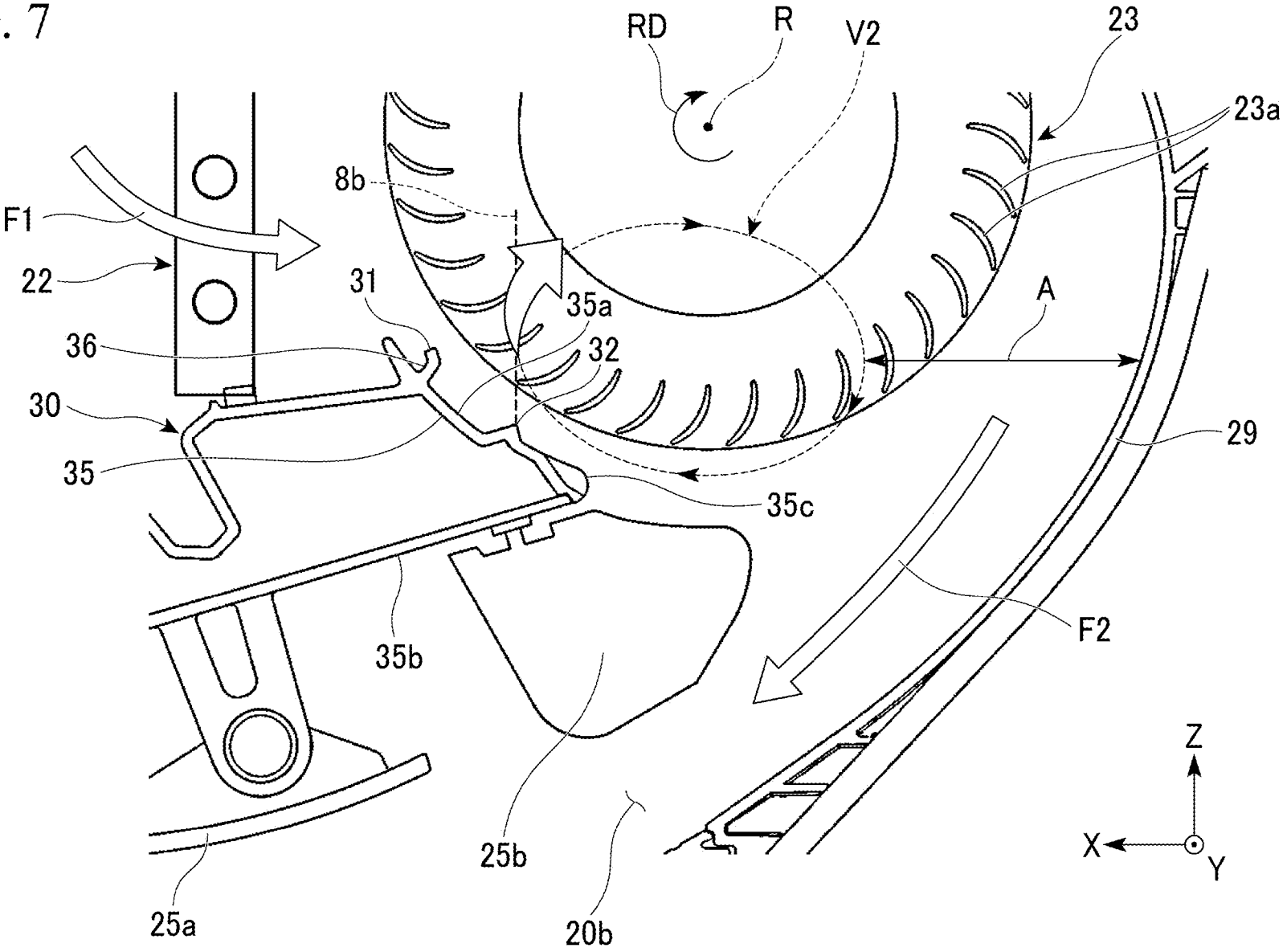
FIG. 7 is a cross-sectional view of the indoor unit in the embodiment, and is a diagram schematically showing a second circulating vortex.

FIGS. 6 and 7 are schematic diagrams showing circulating vortices V1 and V2 formed inside the housing 21 by the cross-flow fan 23 and the stabilizer 30. FIG. 6 is a diagram showing a first circulating vortex V1 formed in a case where a ventilation resistance of the suction port 20*a* is high. On the other hand, FIG. 7 is a diagram showing a second circulating vortex V2 formed during a steady state in which a sufficient air volume is secured in the suction flow path F1.

In the following description, a state in which the first circulating vortex V1 as shown in FIG. 6 is formed is referred to as a first state, and a state in which the second circulating vortex V2 as shown in FIG. 7 is formed is referred to as a second state.

As shown in FIGS. 6 and 7, the circulating vortices V1 and V2 are vertex-like winds that pass through the inside of the cross-flow fan 23 and between the cross-flow fan 23 and the tongue portion 35. The circulating vortices V1 and V2 rotate clockwise as viewed from the right side (+Y side). In addition, inside the housing 21, the circulating vortices V1 and V2 are formed, and a flow from the suction flow path F1 across the inside of the cross-flow fan 23 to the blowout flow path F2 is formed.

A blowout region A is provided between the circulating vortices V1 and V2 and the casing portion 29. The blowout region A is a region extending in the front-rear direction and the left-right direction Y of the blowout flow path F2. The air passing through the blowout region A among the air discharged from the cross-flow fan 23 flows into the room from the blowout port 20*b*. On the other hand, the air that passes through a front side (+X side) of the blowout region A of the air discharged from the cross-flow fan 23 circulates inside and outside the cross-flow fan 23 as the circulating vortices V1 and V2.

In the indoor unit 20 shown in FIG. 3, dust is continuously deposited on the filter 40 as the operation time increases until the filter 40 is cleaned. In this case, the ventilation resistance of the suction port 20*a* increases, and a pressure of the suction flow path F1 decreases. The first state shown in FIG. 6 appears in a case where the pressure of the suction flow path F1 decreases. On the other hand, the second state appears in a case where the ventilation resistance of the suction port 20*a* is sufficiently low and the pressure of the suction flow path F1 can be sufficiently maintained.

As shown in FIG. 6, the first circulating vortex V1 in the first state is larger than the second circulating vortex V2, and the blowout region A is narrowed in the front-rear direction. Furthermore, in the first state, since the pressure of the suction flow path F1 decreases, the air in the room flows back into the housing 21 via the blowout port 20*b* and is easily drawn into the first circulating vortex V1. In a case where the back flow occurs, a blowing efficiency deteriorates. Furthermore, in a case where a back flow occurs during the cooling operation, humid indoor air comes into contact with the cross-flow fan 23 having a low temperature, and condensation occurs on the blades 23*a* of the cross-flow fan 23.

According to the present embodiment, the first protrusion portion 31 is provided on the facing surface 35*a* of the tongue portion 35. The first protrusion portion 31 functions as a starting point 8*a* on the suction flow path F1 side of the first circulating vortex V1 that increases as the ventilation resistance increases. That is, the air of the first circulating vortex V1 flows from the blowout flow path F2 side to the suction flow path F1 side along the facing surface 35*a* of the tongue portion 35, hits the first protrusion portion 31, is blown up to the upper side, and enters the inside of the cross-flow fan 23. According to the present embodiment, a position of the starting point 8*a* of the first circulating vortex V1 in the case where the ventilation resistance increases can be stabilized. This can suppress the narrowing of the blowout region A of the first circulating vortex V1 (−X side), thereby suppressing the back flow of the indoor air from the blowout port 20*b*. As a result, not only can the blowing efficiency by the cross-flow fan 23 be enhanced, but also the occurrence of condensation on the blades 23*a* of the cross-flow fan 23 during the cooling operation can be suppressed.

The first protrusion portion 31 of the present embodiment extends over the entire axial length of the cross-flow fan 23. Therefore, the starting point 8*a* of the first circulating vortex V1 can be set to the same position at any location in the axial direction. That is, according to the present embodiment, the first circulating vortex V1 having the same shape can be stably formed at any position in the axial direction.

As shown in FIG. 7, in the second state in which the pressure of the suction flow path F1 is sufficiently high, the suction flow path F1 is widely formed in the vertical direction Z. Therefore, the second circulating vortex V2 is smaller than the first circulating vortex V1, and the blowout region A is widened in the front-rear direction. In this case, in a case where only the first protrusion portion 31 is provided on the facing surface 35*a* of the tongue portion 35, a circulating vortex collides head-on with the end portion 35*c* of the tongue portion 35 and causes a large pressure fluctuation. Such a pressure fluctuation causes a rotation sound of the cross-flow fan 23.

According to the present embodiment, the second protrusion portion 32 is provided on the facing surface 35*a* of the tongue portion 35 in addition to the first protrusion portion 31. The second protrusion portion 32 is located closer to the blowout flow path F2 than the first protrusion portion 31. The second protrusion portion 32 functions as a starting point 8*b* on the suction flow path F1 side of the second circulating vortex V2. That is, the air of the second circulating vortex V2 flows from the blowout flow path F2 side to the suction flow path F1 side along the facing surface 35*a* of the tongue portion 35, hits the second protrusion portion 32, is blown up to the upper side, and enters the inside of the cross-flow fan 23. According to the present embodiment, the starting point 8*b* of the second circulating vortex V2 can be stabilized on the blowout flow path F2 side with respect to the first circulating vortex V1. Accordingly, the air of the second circulating vortex V2 is likely to flow along the facing surface 35*a* of the tongue portion 35 without colliding with the end portion 35*c* of the tongue portion 35, and the pressure fluctuation in the vicinity of the end portion 35*c* of the tongue portion is reduced, so that the rotation sound of the cross-flow fan 23 can be reduced.

The second protrusion portion 32 according to the present embodiment extends over the entire axial length of the cross-flow fan 23. Therefore, the starting point 8*b* of the second circulating vortex V2 can also be the same position at any location in the axial direction. That is, according to the present embodiment, the second circulating vortex V2 having the same shape can be stably formed at any position in the axial direction.

As shown in FIG. 5, a first gap C1 between the first protrusion portion 31 and the cross-flow fan 23 is smaller than a second gap C2 between the second protrusion portion 32 and the cross-flow fan 23 (C1<C2). That is, a tip of the first protrusion portion 31 is disposed closer to the cross-flow fan 23 than a tip of the second protrusion portion 32. A "distance between the protrusion portion and the cross-flow fan" means a "distance between the protrusion portion and the outer circumference of the cross-flow fan (that is, the rotation trajectory of radially outer end portions of the blades)".

The first circulating vortex V1 in the first state flows along the facing surface 35*a* of the tongue portion 35, hits the first protrusion portion 31 after crossing the second protrusion portion 32, and is blown up to the upper side. By causing the second gap C2 to be larger than the first gap C1, the first circulating vortex V1 can easily pass through between the first protrusion portion 31 and the cross-flow fan 23. In addition, by causing the first gap C1 to be smaller than the second gap C2, the first circulating vortex V1 can easily hit the first protrusion portion 31, and the first protrusion portion 31 can function as the starting point 8*a* of the first circulating vortex V1. On the other hand, since the second circulating vortex V2 in the second state is a relatively small vortex, it is difficult for the second circulating vortex V2 to cross the second protrusion portion 32 even in a case where the second gap C2 is relatively wide, and the second circulating vortex V2 hits the second protrusion portion 32 and is blown up to the upper side.

As shown in FIG. 5, in the present embodiment, a difference (C2−C1) between the first gap C1 and the second gap C2 is preferably 0.5% or more of a diameter of the cross-flow fan 23. As an example, in a case where an outer diameter of the cross-flow fan 23 is 106 mm, the difference between the first gap C1 and the second gap C2 is preferably 0.6 mm or more. By setting the first gap C1 and the second gap C2 in such a relationship, the first circulating vortex V1 can be stably formed in the first state, and the second circulating vortex V2 can be stably formed in the second state.

In the present embodiment, the first gap C1 is the narrowest gap between the stabilizer 30 and the cross-flow fan 23. In addition, the second gap C2 is the second narrowest gap between the stabilizer 30 and the cross-flow fan 23. That is, portions of the tongue portion 35 except the first protrusion portion 31 and the second protrusion portion 32 are not closer to the cross-flow fan 23 than the first protrusion portion 31 and the second protrusion portion 32. According to the present embodiment, functioning of the portions of the tongue portion 35 other than the first protrusion portion 31 and the second protrusion portion 32 as the starting point can be suppressed, and the starting point of the circulating vortex can be easily controlled by the first protrusion portion 31 and the second protrusion portion 32.

As shown in FIG. 5, an imaginary line connecting the rotation axis R of the cross-flow fan 23 and the tip of the first protrusion portion 31 is defined as a first imaginary line L1 as viewed in the axial direction of the cross-flow fan 23. In addition, an imaginary line connecting the rotation axis R and the tip of the second protrusion portion 32 is defined as a second imaginary line L2. Furthermore, an imaginary line connecting the rotation axis R and the end portion 35*c* of the tongue portion 35 is defined as a third imaginary line L3.

According to the present embodiment, a ratio of an angle α between the first imaginary line L1 and the second imaginary line L2 to an angle γ between the first imaginary line L1 and the third imaginary line L3 is larger than 50%. That is, the second protrusion portion 32 is disposed between the end portion 35*c* of the tongue portion 35 and the first protrusion portion 31 to be biased toward an end portion 35*c* side of the tongue portion 35.

In a case where the second protrusion portion 32 is disposed to be biased toward a first protrusion portion 31, the second circulating vortex V2 is likely to collide with the end portion 35*c* of the tongue portion 35 in the second state, and an effect of reducing the pressure fluctuation in the vicinity of the end portion 35*c* of the tongue portion 35 cannot be sufficiently obtained. According to the present embodiment, by disposing the second protrusion portion 32 to be biased toward the end portion 35*c* side of the tongue portion 35, the starting point 8*b* of the second circulating vortex V2 can be disposed sufficiently to the rear side (−X side). Accordingly, the air of the second circulating vortex V2 can easily flow along the facing surface 35*a* of the tongue portion 35.

In addition, the ratio of the angle α between the first imaginary line L1 and the second imaginary line L2 to the angle γ between the first imaginary line L1 and the third imaginary line L3 is preferably less than 62%. In a case where the ratio of the angle α to the angle γ is too large, the second circulating vortex V2 formed in the second state is biased to the rear side (−X side) too much, the blowout region A is narrowed in the front-rear direction, and the air volume passing through the blowout flow path F2 is reduced, which may deteriorate aerodynamic performance. According to the present embodiment, by setting the ratio of the angle α to the angle γ to be less than 62%, a width of the blowout region A can be sufficiently secured, and the air volume of the blowout flow path F2 can be sufficiently secured.

The first protrusion portion 31 has a first rectifying surface 31*a* that faces the blowout flow path F2. The first rectifying surface 31*a* is inclined toward the suction flow path F1 toward a tip side of the first protrusion portion 31. Furthermore, the first rectifying surface 31*a* of the present embodiment has a first inclined portion 31*e* and a second inclined portion 31*f*, which have different inclination angles from each other. The first inclined portion 31*e* is disposed on a root side of the first protrusion portion 31, and the second inclined portion 31*f* is disposed on a tip side of the first protrusion portion 31. That is, the second inclined portion 31*f* is located closer to the tip side of the first protrusion portion 31 than the first inclined portion 31*e*.

The inclination angle of the first inclined portion 31*e* with respect to the fourth imaginary line (imaginary line) L4 extending from the rotation axis R of the cross-flow fan 23 toward the first inclined portion 31*e* in the radial direction is referred to as a first inclination angle θ1. In addition, the inclination angle of the second inclined portion 31*f* with respect to the first imaginary line L1 extending from the rotation axis R toward the second inclined portion 31*f* in the radial direction is referred to as a second inclination angle θ2. The first inclination angle θ1 and the second inclination angle θ2 are the inclination angles of the first inclined portion 31*e* and the second inclined portion 31*f* with respect to the radial direction of the rotation axis R.

In the present embodiment, the first inclination angle θ1 and the second inclination angle θ2 are each an acute angle. Therefore, the first rectifying surface 31*a* of the first protrusion portion 31 is inclined at an acute angle with respect to the radial direction toward the suction flow path F1 over an entire region from the root side to the tip side.

In a case where the first rectifying surface 31*a* is parallel to the radial direction of the rotation axis R or is inclined toward the blowout flow path F2, there is a concern that the first circulating vortex V1 collides with the first rectifying surface 31*a*, causing a large pressure fluctuation, and increasing the rotation sound of the cross-flow fan 23. According to the present embodiment, since the first rectifying surface 31*a* is inclined at an acute angle with respect to the radial direction of the rotation axis R toward the suction flow path F1, the first circulating vortex V1 can be smoothly guided to the inside of the cross-flow fan 23 at the first protrusion portion 31.

In the present embodiment, the second inclination angle θ2 is larger than the first inclination angle θ1. That is, the second inclined portion 31*f* has a larger inclination angle with respect to the radial direction of the cross-flow fan 23 than the first inclined portion 31*e*. Therefore, the first protrusion portion 31 steeply rises from the facing surface 35*a* in the first inclined portion 31*e*, and gently inclines toward the rotation direction of the cross-flow fan 23 in the second inclined portion 31*f* on the tip side.

As described above, the air of the first circulating vortex V1 passes through between the facing surface 35*a* of the tongue portion 35 and the outer circumference of the cross-flow fan 23. In addition, the air of the first circulating vortex V1 hits the first protrusion portion 31 after crossing the second protrusion portion 32. The air of the first circulating vortex V1 passes through a region that is biased toward the cross-flow fan 23 than the tip of the second protrusion portion 32 by crossing the second protrusion portion 32. Therefore, the air of the first circulating vortex V1 is more likely to hit a region of the first rectifying surface 31*a* of the first protrusion portion 31, which is close to the cross-flow fan 23 (that is, the second inclined portion 31*f*), and is less likely to hit the first inclined portion 31*e* located on the root side of the first protrusion portion 31.

According to the present embodiment, by forming the first inclined portion 31*e* into the steep shape, the first protrusion portion 31 can be reduced in the front-rear direction. In addition, according to the present embodiment, since the first rectifying surface 31*a* has a bent shape on the tip side, the rigidity of the first protrusion portion 31 can be increased compared to a case where the entire first rectifying surface 31*a* is inclined at a uniform inclination angle.

The second protrusion portion 32 has the second rectifying surface 32*a* that faces the blowout flow path F2. The second rectifying surface 32*a* is inclined toward the suction flow path F1 toward a tip side of the second protrusion portion 32. An inclination angle of the second rectifying surface 32*a* with respect to the second imaginary line (imaginary line) L2 extending in the radial direction from the rotation axis R of the cross-flow fan 23 toward the second rectifying surface 32*a* is referred to as a third inclination angle θ3. The first inclination angle θ1 and the second inclination angle θ2 are the inclination angles of the first rectifying surface 31*a* with respect to the radial direction of the rotation axis R. In the present embodiment, the second rectifying surface 32*a* of the second protrusion portion 32 is inclined at an acute angle with respect to the radial direction of the rotation axis R over an entire region from a root side to the tip side.

In a case where the second rectifying surface 32*a* is parallel to the radial direction of the rotation axis R or is inclined toward the blowout flow path F2, there is a concern that the second circulating vortex V2 collides with the second rectifying surface 32*a*, causing a large pressure fluctuation, and increasing the rotation sound of the cross-flow fan 23. According to the present embodiment, since the second rectifying surface 32*a* is inclined at an acute angle with respect to the radial direction of the rotation axis R toward the suction flow path F1, the first circulating vortex V1 can be smoothly guided to the inside of the cross-flow fan 23 at the second protrusion portion 32.

As described above, each configuration and each method described in the present specification can be combined as appropriate within the scope in which all of these do not contradict each other.

For example, in the embodiment described above, a case where the suction port 20*a* is disposed on the upper side and the blowout port 20*b* is disposed on the lower side with respect to the cross-flow fan 23 has been described. However, the disposition of the suction port 20*a* and the blowout port 20*b* with respect to the cross-flow fan 23 is not limited to the embodiment.

The invention claimed is:

1. An indoor unit of an air conditioner, comprising:

a heat exchanger;

a cross-flow fan that rotates around a rotation axis;

a housing that includes a suction port and a blowout port and that accommodates the heat exchanger and the cross-flow fan therein; and a stabilizer that separates a suction flow path and a blowout flow path of the cross-flow fan from each other, wherein the stabilizer includes a tongue portion that extends along an outer circumferential surface of the cross-flow fan and that has a facing surface facing the cross-flow fan, a first protrusion portion that protrudes from the facing surface toward the cross-flow fan, and a second protrusion portion that protrudes from the facing surface toward the cross-flow fan and that is located closer to the blowout flow path than the first protrusion portion, the first protrusion portion has a first rectifying surface that faces the blowout flow path and that is inclined toward the suction flow path toward a tip side of the first protrusion portion, the second protrusion portion has a second rectifying surface that faces the blowout flow path and that is inclined toward the suction flow path toward a tip side of the second protrusion portion, the first rectifying surface and the second rectifying surface are each inclined toward the suction flow path at an acute inclination angle with respect to a radial direction of the rotation axis, a first gap between the first protrusion portion and the cross-flow fan is smaller than a second gap between the second protrusion portion and the cross-flow fan, and a difference between the first gap and the second gap is 0.5% or more of a diameter of the cross-flow fan.

2. The indoor unit according to claim 1, wherein, as viewed in an axial direction of the cross-flow fan, when an imaginary line connecting the rotation axis and a tip of the first protrusion portion is referred to as a first imaginary line, an imaginary line connecting the rotation axis and a tip of the second protrusion portion is referred to as a second imaginary line, and an imaginary line connecting the rotation axis and an end portion of the tongue portion closer to the blowout flow path is referred to as a third imaginary line, a ratio of an angle between the first imaginary line and the second imaginary line to an angle between the first imaginary line and the third imaginary line is larger than 50%.

3. The indoor unit according to claim 1, wherein the first rectifying surface has a first inclined portion and a second inclined portion located closer to the tip side of the first protrusion portion than the first inclined portion, and an inclination angle of the second inclined portion with respect to the radial direction is larger than an inclination angle of the first inclined portion with respect to the radial direction.

4. The indoor unit according to claim 1, wherein the tongue portion and the first protrusion portion are plate-shaped, and the stabilizer has a recess portion that is surrounded by the tongue portion and the first protrusion portion and opens upward.

5. The indoor unit according to claim 1, wherein the second protrusion portion is constituted by a flat rectifying surface facing the blowout flow path and a flat opposite side surface facing the suction flow path.

6. The indoor unit according to claim 1, wherein the first protrusion portion and the second protrusion portion extend over an entire axial length of the cross-flow fan.

7. An air conditioner comprising:

the indoor unit according to claim 1; and an outdoor unit.

* * * * *